US008249882B2

(12) United States Patent
Makiuchi et al.

(10) Patent No.: US 8,249,882 B2
(45) Date of Patent: Aug. 21, 2012

(54) DECODING APPARATUS AND DECODING METHOD

(75) Inventors: Takashi Makiuchi, Fukuoka (JP); Masanao Suzuki, Kawasaki (JP); Yoshiteru Tsuchinaga, Fukuoka (JP); Miyuki Shirakawa, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 792 days.

(21) Appl. No.: 11/902,732

(22) Filed: Sep. 25, 2007

(65) Prior Publication Data

US 2008/0288262 A1 Nov. 20, 2008

(30) Foreign Application Priority Data

Nov. 24, 2006 (JP) ..... 2006-317646

(51) Int. Cl.

| | |
|---|---|
| ***G10L 19/00*** | (2006.01) |
| ***G10L 21/04*** | (2006.01) |
| ***G10L 11/00*** | (2006.01) |
| ***G10L 19/14*** | (2006.01) |
| ***G10L 11/04*** | (2006.01) |

(52) U.S. Cl. ..... 704/500; 704/219; 704/200; 704/501; 704/502; 704/503; 704/504; 704/205; 704/206; 704/225

(58) Field of Classification Search ..... 704/219, 704/200, 205, 206, 225, 500–504; 700/94
See application file for complete search history.

(56) References Cited

U.S. PATENT DOCUMENTS

| | | | | |
|---|---|---|---|---|
| 5,848,164 | A * | 12/1998 | Levine | 381/61 |
| 5,974,380 | A * | 10/1999 | Smyth et al. | 704/229 |
| 6,925,116 | B2 | 8/2005 | Liljeryd et al. | |
| 6,978,236 | B1 * | 12/2005 | Liljeryd et al. | 704/219 |
| 7,181,389 | B2 * | 2/2007 | Liljeryd et al. | 704/219 |
| 7,246,065 | B2 * | 7/2007 | Tanaka et al. | 704/500 |
| 7,283,955 | B2 | 10/2007 | Liljeryd et al. | |
| 7,328,162 | B2 | 2/2008 | Liljeryd et al. | |
| 7,469,206 | B2 * | 12/2008 | Kjorling et al. | 704/205 |
| 7,734,473 | B2 * | 6/2010 | Schuijers et al. | 704/503 |
| 2003/0187663 | A1 * | 10/2003 | Truman et al. | 704/500 |
| 2005/0096917 | A1 * | 5/2005 | Kjorling et al. | 704/500 |

(Continued)

FOREIGN PATENT DOCUMENTS

JP 2001-521648 A 11/2001

(Continued)

OTHER PUBLICATIONS

V.S. Babu, A.K. Malot, V.M. Vijayachandran, M.K. Vinay, "Transient Detection for Transform Domain Coders", 116th AES Conv., preprint 6175, Berlin 2004.*

(Continued)

*Primary Examiner* — Douglas Godbold
*Assistant Examiner* — Edgar Guerra-Erazo
(74) *Attorney, Agent, or Firm* — Fujitsu Patent Center

(57) ABSTRACT

A decoding apparatus that decodes a first encoded data that is encoded into a first time range from a low-frequency component of an audio signal, and a second encoded data that is used when creating a high-frequency component of the audio signal from the low-frequency component and encoded into a second time range, into the audio signal. In the decoding apparatus, a high-frequency component compensating unit that compensates the high-frequency component created from the second encoded data based on the first time range. A decoding unit that decodes into the audio signal by synthesizing the high-frequency component compensated by the high-frequency component compensating unit, and the low-frequency component decoded from the first encoded data.

12 Claims, 15 Drawing Sheets

U.S. PATENT DOCUMENTS

| | | | | |
|---|---|---|---|---|
| 2006/0031064 | A1* | 2/2006 | Liljeryd et al. | 704/219 |
| 2006/0053018 | A1* | 3/2006 | Engdegard et al. | 704/500 |
| 2006/0165237 | A1* | 7/2006 | Villemoes et al. | 381/20 |
| 2006/0256971 | A1* | 11/2006 | Chong et al. | 381/23 |
| 2007/0016411 | A1* | 1/2007 | Kim et al. | 704/226 |
| 2007/0129036 | A1* | 6/2007 | Arora | 455/205 |
| 2008/0183466 | A1* | 7/2008 | Nongpiur et al. | 704/226 |
| 2008/0262835 | A1* | 10/2008 | Oshikiri | 704/205 |
| 2009/0192804 | A1* | 7/2009 | Schuijers et al. | 704/500 |

FOREIGN PATENT DOCUMENTS

| | | | |
|---|---|---|---|
| JP | 2002-041097 | A | 2/2002 |
| JP | 2003-255973 | A | 9/2003 |
| JP | 2003-529787 | A | 10/2003 |
| JP | 2004-350077 | A | 12/2004 |
| JP | 2006-126372 | | 5/2006 |
| WO | WO-01/26095 | A1 | 4/2001 |
| WO | WO-2005/036527 | A1 | 4/2005 |

OTHER PUBLICATIONS

J. Kliewer et al., "Audio Subband Coding with Improved Representation of Transient Signal Segments", Signal Processing: Theodes and Applications, Proceedings of EUSIPCO, Sep. 1, 1998, pp. 2345-2348, XP001014252.*

Ekstrand, P.; "Bandwidth Extension of Audio Signals by Spectral Band Replication"; Nov. 15, 2002; proc. 1st IEEE Benelux Workshop on Model based Processing and coding of Audio (MPCA-2002); Leuven, Belqium.*

Schnell et. al; "Enhanced MPEG-4 Low Delay AAC-Low Bitrate High Quality Communication"; May 2007; 122nd Audio Engineering Society Convention.*

M. Dietz and S. Meltzer, "CT-aacPlus—a state-of-the-art Audio coding scheme," EBU Technical Review, Jul. 2002, http://www.ebu.ch/trev_291-dietz.pdf.*

"Japanese Office Action" mailed by JPO and corresponding to Japanese application No. 2006-317646 on Jun. 7, 2011, with partial English translation.

Japanese Office Action mailed on Mar. 6, 2012 for corresponding Japanese Application No. 2006-317646, with English-language Translation.

European Search Report mailed Aug. 23, 2011 for corresponding European Application No. EP 07 02 0285.

"G.729 based Embedded Variable bit-rate coder: An 8-32 kbit/s scalable wideband coder bitstream interoperable with G.729; G729.1(May 2006)", ITU-T Standard, International Telecommunication Union, Geneva;CH, No. G729.1 (May 2006); May 29, 2006, pp. 1-100.

* cited by examiner

EXAMPLE OF GROUPING
(#N INDICATING SUBFRAME NUMBER)

DECODING APPARATUS AND DECODING METHOD

BACKGROUND OF THE INVENTION

1. Field of the Invention

The present invention relates to a technology for decoding an audio signal.

2. Description of the Related Art

Recently, the High-Efficiency Advanced Audio Coding (HE-AAC) method is used for encoding voice, sound, and music. The HE-AAC method is an audio compression method, which is principally used, for example, by the Moving Picture Experts Group phase 2 (MPEG-2), or the Moving Picture Experts Group phase 4 (MPEG-4).

According to encoding by the HE-AAC method, a low-frequency component of an audio signal to be encoded (a signal related to voice, sound, and music etc) is encoded by the Advanced Audio Coding (AAC) method, and a high-frequency component of the audio signal is encoded by the Spectral Band Replication (SBR) method. According to the SBR method, a high-frequency component of an audio signal can be encoded with bit counts fewer than usual by encoding only a portion that cannot be estimated from a low-frequency component of the audio signal. Hereinafter, data encoded by the AAC method is referred to as AAC data, and data encoded by the SBR method is referred to as SBR data.

An example of a decoder for decoding data encoded by the HE-AAC method (HE-AAC data) is explained below. As shown in FIG. 14, a decoder 10 includes a data separating unit 11, an AAC decoding unit 12, an analyzing filter 13, a high-frequency creating unit 14, and a synthesizing filter 15.

When the data separating unit 11 acquires HE-AAC data, the data separating unit 11 separates the acquired HE-AAC data into the AAC data and the SBR data, outputs the AAC data to the AAC decoding unit 12, and outputs the SBR data to the high-frequency creating unit 14.

The AAC decoding unit 12 decodes the AAC data, and outputs the decoded AAC data to the analyzing filter 13 as AAC decoded audio data. The analyzing filter 13 calculates characteristics of time and frequencies related to a low-frequency component of the audio signal based on the AAC decoded audio data acquired from the AAC decoding unit 12, and outputs a calculation result to the synthesizing filter 15 and the high-frequency creating unit 14. Hereinafter, a calculation result output from the analyzing filter 13 is referred to as low-frequency component data.

The high-frequency creating unit 14 creates a high-frequency component of the audio signal based on the SBR data acquired from the data separating unit 11, and the low-frequency component data acquired from the analyzing filter 13. The high-frequency creating unit 14 then outputs the data of the created high-frequency component as a high-frequency component data to the synthesizing filter 15.

The synthesizing filter 15 synthesizes the low-frequency component data acquired from the analyzing filter 13 and the high-frequency component data acquired from the high-frequency creating unit 14, and outputs the synthesized data as HE-AAC output audio data.

Processing performed by the decoder 10 is explained below. The analyzing filter 13 creates low-frequency component data as shown in the left part of FIG. 15. As shown in the right part of FIG. 15, the high-frequency creating unit 14 creates high-frequency component data from the low-frequency component data, and the synthesizing filter 15 synthesizes the low-frequency component data and the high-frequency component data, so that HE-AAC output audio data is created. Thus, the audio signal encoded by the HE-AAC data method is decoded to the HE-AAC output audio data by the decoder 10.

Japanese Patent Application Laid-open No. 2006-126372 discloses an encoding method, according to which when an audio signal is received, and if the audio signal includes an abrupt amplitude change, frequency spectra of the audio signal are divided into a plurality of groups, and bit assignment and quantization are performed on each of the groups.

However, if an audio signal that includes attack sound (a signal including an abrupt amplitude change) is encoded (for example, by the HE-AAC method), and the encoded audio signal is decoded afterward, the above conventional technology cannot properly encode high-frequency component of the audio signal.

A problem in the conventional technology is specifically explained below. As shown in FIG. 16, when encoding an audio signal that includes an abrupt amplitude change within an extremely short time by the SBR method, there is a case where a time region in which the attack sound occurs is extremely short compared with a time region divided by the SBR method due to a characteristic of the SBR method (or the time resolution according to the SBR method is rougher than the time resolution according to the AAC method). The reason for this is because the power of the time region that includes attack sound is evened out, so that attack sound is encoded in a rather slower pace.

The case where the time resolution according to the SBR method is rougher than the time resolution according to the AAC method is explained below. In encoding of an audio signal by the HE-AAC method, encoding is performed by the SBR method at first, and then encoding is performed by the AAC method. In each of the SBR method and the AAC method, encoding is performed by determining whether the audio signal include attack sound, and adjusting the time resolution based on a determination result (if an attack sound is included, the time resolution is set to fine, and if attack sound is not included, the time resolution is set to rough). However, sometimes attack sound is not detected despite that the audio signal includes attack sound. In such case, the time resolution according to the SBR method is rougher than the time resolution according to the AAC method.

In other words, it is strongly required to decode an encoded audio signal properly by compensating a high-frequency component of the encoded audio signal, even if a high-frequency component of the audio signal that includes an attack sound is not properly encoded by the HE-AAC method.

SUMMARY OF THE INVENTION

It is an object of the present invention to at least partially solve the problems in the conventional technology.

According to an aspect of the present invention, a decoding apparatus decodes a first encoded data that is encoded into a first time range from a low-frequency component of an audio signal, and a second encoded data that is used when creating a high-frequency component of the audio signal from the low-frequency component and encoded into a second time range, into the audio signal. The decoding apparatus includes a high-frequency component compensating unit that compensates the high-frequency component created from the second encoded data based on the first time range, and a decoding unit that decodes into the audio signal by synthesizing the high-frequency component compensated by the high-frequency component compensating unit, and the low-frequency component decoded from the first encoded data.

According to another aspect of the present invention, a decoding method decodes a first encoded data that is encoded into a first time range from a low-frequency component of an audio signal, and a second encoded data that is used when creating a high-frequency component of the audio signal from the low-frequency component and encoded into a second time range, into the audio signal. The decoding method includes high-frequency compensating the high-frequency component created from the second encoded data based on the first time range, and decoding into the audio signal by synthesizing the high-frequency component compensated at the high-frequency compensating, and the low-frequency component decoded from the first encoded data.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to accompanying drawings.

First Embodiment

Figure 1:
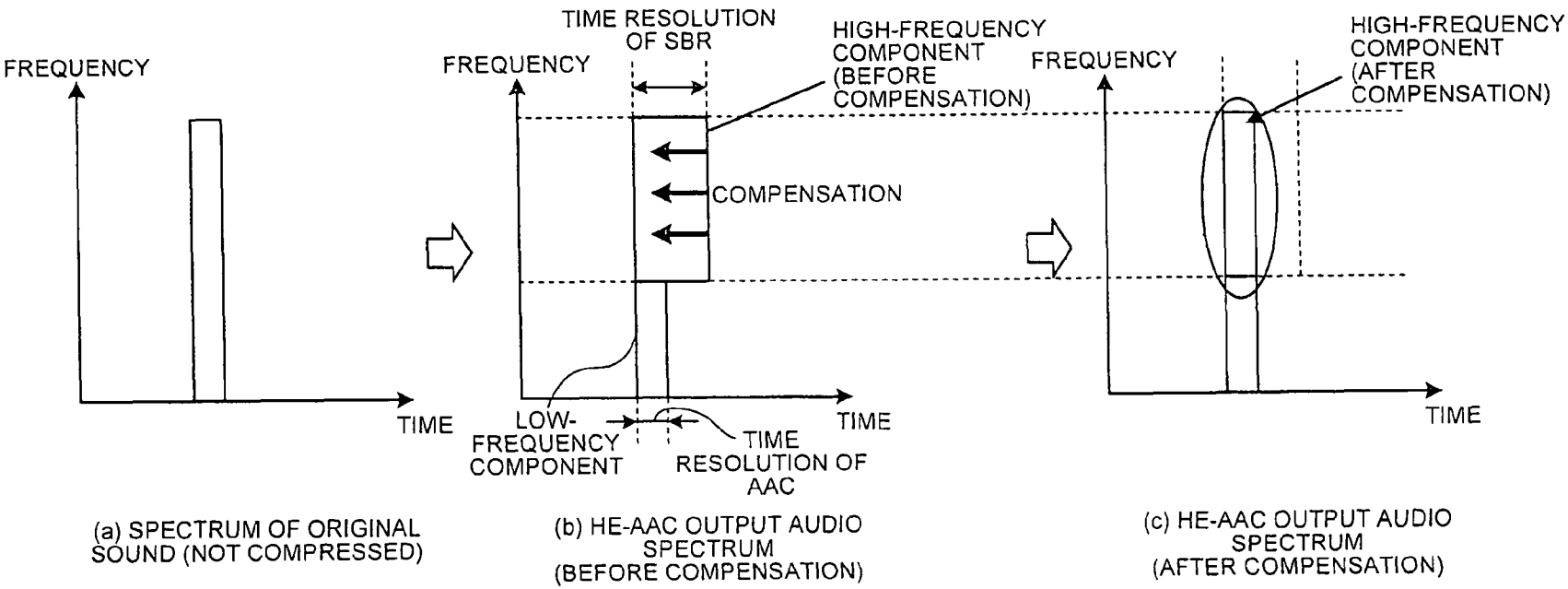
FIG. 1 is a schematic diagram for explaining an overview and characteristics of a decoder according to a first embodiment of the present invention.

An overview and characteristics of a decoder 100 according to a first embodiment of the present invention are explained below. As shown in FIG. 1, when the decoder 100 acquires and decodes an audio signal encoded by the High-Efficiency Advanced Audio Coding (HE-AAC) method (hereinafter, "HE-AAC data"), the decoder 100 corrects the time range of high-frequency component data included in HE-AAC data to the time range of low-frequency component data included in the HE-AAC data, and the power of a high-frequency component, which has been evened out in the time range before correction, is compensated in accordance with the time range after correction.

The time range of the high-frequency component data corresponds to time resolution for encoding data by the Spectral Band Replication (SBR) method, and the time range of the low-frequency component data corresponds to time resolution for encoding data by the Advanced Audio Coding (AAC) method. Hereinafter, data encoded by the SBR method is referred to as SBR data, and data encoded by the AAC method is referred to as AAC data. The SBR data and the AAC data are included in the HE-AAC data.

Thus, the decoder 100 can properly decode an audio signal, even if a high-frequency component of the audio signal (SBR data) is not properly encoded by the HE-AAC method.

Figure 2:
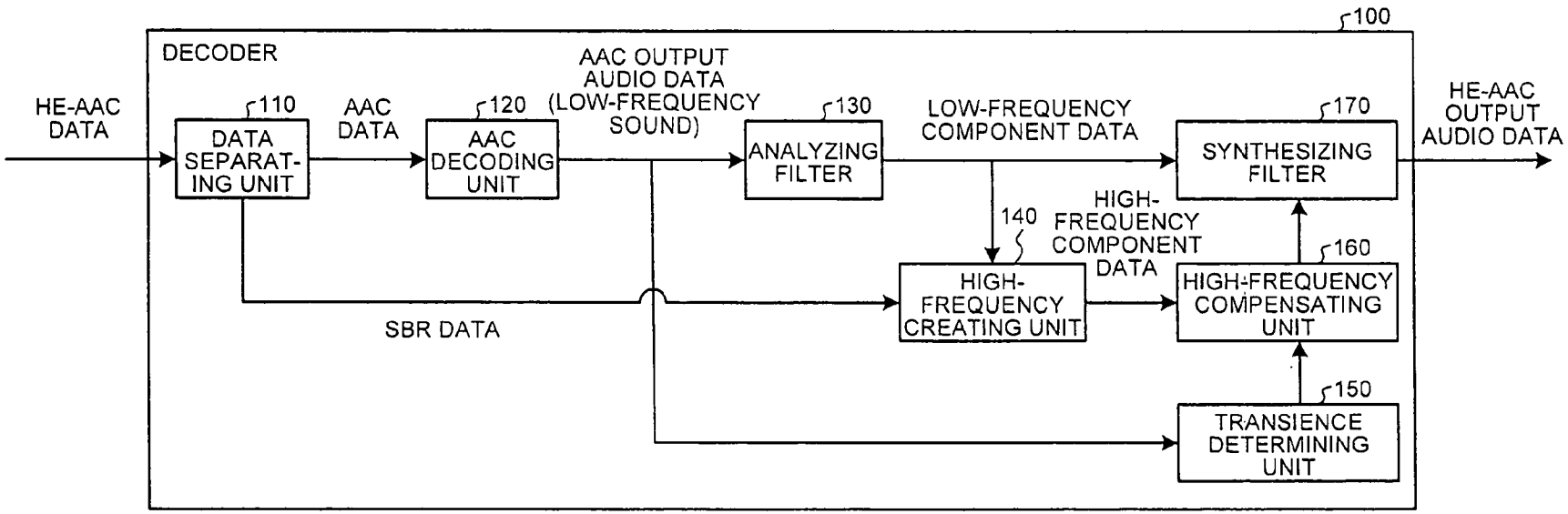
FIG. 2 is a functional block diagram of the decoder shown in FIG. 1.

A configuration of the decoder 100 is explained below. As shown in FIG. 2, the decoder 100 includes a data separating unit 110, an AAC decoding unit 120, an analyzing filter 130, a high-frequency creating unit 140, a transience determining unit 150, a high-frequency compensating unit 160, and a synthesizing filter 170.

When the data separating unit 110 acquires data encoded according to the HE-AAC method (hereinafter, "HE-AAC data"), the data separating unit 110 separates the acquired HE-AAC data into the Advanced Audio Coding (AAC) data and the SBR data, outputs the AAC data to the AAC decoding unit 120, and outputs the SBR data to the high-frequency creating unit 140.

The AAC decoding unit 120 decodes AAC data, and outputs the decoded AAC data as AAC output audio data to the analyzing filter 130 and the transience determining unit 150. The analyzing filter 130 calculates characteristics of time and frequency related to a low-frequency component of an audio signal based on AAC output audio data acquired from the AAC decoding unit 120, and outputs a calculation result to the synthesizing filter 170 and the high-frequency creating unit 140. Hereinafter, the calculation result output from the analyzing filter 130 is referred to as low-frequency component data.

The high-frequency creating unit 140 creates a high-frequency component of the audio signal based on SBR data acquired from the data separating unit 110 and low-frequency component data acquired from the analyzing filter 130. The high-frequency creating unit 140 then outputs the data of the created high-frequency component as the high-frequency component data of the audio signal to the high-frequency compensating unit 160.

The transience determining unit 150 acquires AAC output audio data from the AAC decoding unit 120, determines whether HE-AAC data includes any attack sound (a signal including an abrupt amplitude change), and outputs a determination result to the high-frequency compensating unit 160.

The high-frequency compensating unit 160 acquires a determination result from the transience determining unit 150, and compensates high-frequency component data based on the acquired determination result. If the high-frequency compensating unit 160 acquires a determination result such that an attack sound is included, the high-frequency compensating unit 160 compensates the high-frequency component data, and outputs the compensated high-frequency component data to the synthesizing filter 170. By contrast, if the high-frequency compensating unit 160 acquires a determination result such that attack sound is not included, the high-frequency compensating unit 160 outputs directly the high-frequency component data to the synthesizing filter 170 without compensating the high-frequency component data.

Figure 3:
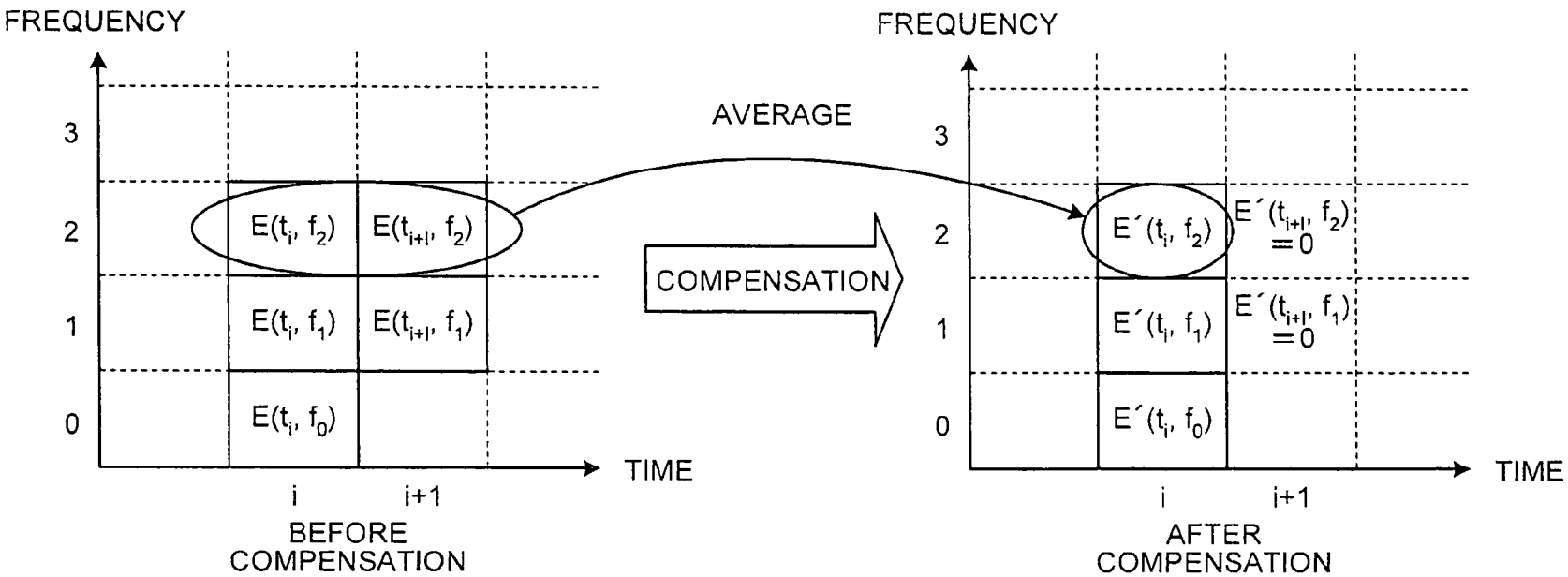
FIG. 3 is a schematic diagram for explaining compensation of high-frequency component data performed by a high-frequency compensating unit shown in FIG. 2.

Compensation of high-frequency component data performed by the high-frequency compensating unit 160 is explained below. As shown in FIG. 3, the high-frequency compensating unit 160 adjusts the time range of the high-frequency component data to the same time range as the low-frequency component data. FIG. 3 presents a case where an example of low-frequency component data acquired from the analyzing filter 130 and high-frequency component data acquired from the high-frequency creating unit 140 are simultaneously drawn on the plane of time and frequency.

A case explained below is where a spectrum of low-frequency component data (low-frequency spectrum) exists only in a time i, while a spectrum of high-frequency component data (high-frequency spectrum) exist in the time and a time (i+1). In FIG. 3, E in each region denotes electric power of a low-frequency component, or a high-frequency component specified with a time t and a frequency f.

The low-frequency component is not to be compensated, so that the electric power is expressed as follows:

$$E(t_i,f_0)=E'(t_i,f_0)$$

where $E(t_i, f_0)$ denotes the power of the low-frequency component before compensation, and $E'(t_i, f_0)$ denotes the power of the low-frequency component after compensation.

$E(t_i, f_1)$, $E(t_i, f_2)$, $E(t_{i+1}, f_1)$, and $E(t_{i+1}, f_2)$ denote the power of the high-frequency components before compensation, while $E'(t_i, f_1)$, $E'(t_i, f_2)$, $E'(t_{i+1}, f_1)$, and $E'(t_{i+1}, f_2)$ denote the electric power of the high-frequency components after compensation.

According to the compensation of the high-frequency components, the electric power in the all time ranges of each of the high-frequency components before compensation is concentrated into the same time range as the low-frequency component (the time range i in FIG. 3). The electric power of the high-frequency component that does not exist in the time range of the low-frequency component is changed to zero. The compensation related to the high-frequency component is expressed by the following expressions:

$$E'(t_i,f_1)=E(t_i,f_1)+E(t_{i+1},f_1)$$

$$E'(t_i,f_2)=E(t_i,f_2)+E(t_{i+1},f_2)$$

$$E'(t_{i+1},f_1)=0$$

$$E'(t_{i+1},f_2)=0$$

Although in the first embodiment the quantity of the time ranges before compensation is two, namely, the time i and the time (i+1), the present invention is not limited to this. Even if time ranges are more than two, the electric power of a high-frequency component is also concentrated into the time range of a low-frequency component likewise. A method of compensating the electric power of a high-frequency component is not limited to the above method. For example, the electric power may be compensated by weighting each of time range.

Returning to FIG. 2, the synthesizing filter 170 synthesizes low-frequency component data acquired from the analyzing filter 130 and high-frequency component data (or compensated high-frequency component data, if an attack sound is included) acquired from the high-frequency compensating unit 160, and outputs the synthesized data as HE-AAC output audio data. The HE-AAC output audio data is a result of decoding HE-AAC data.

Figure 4:
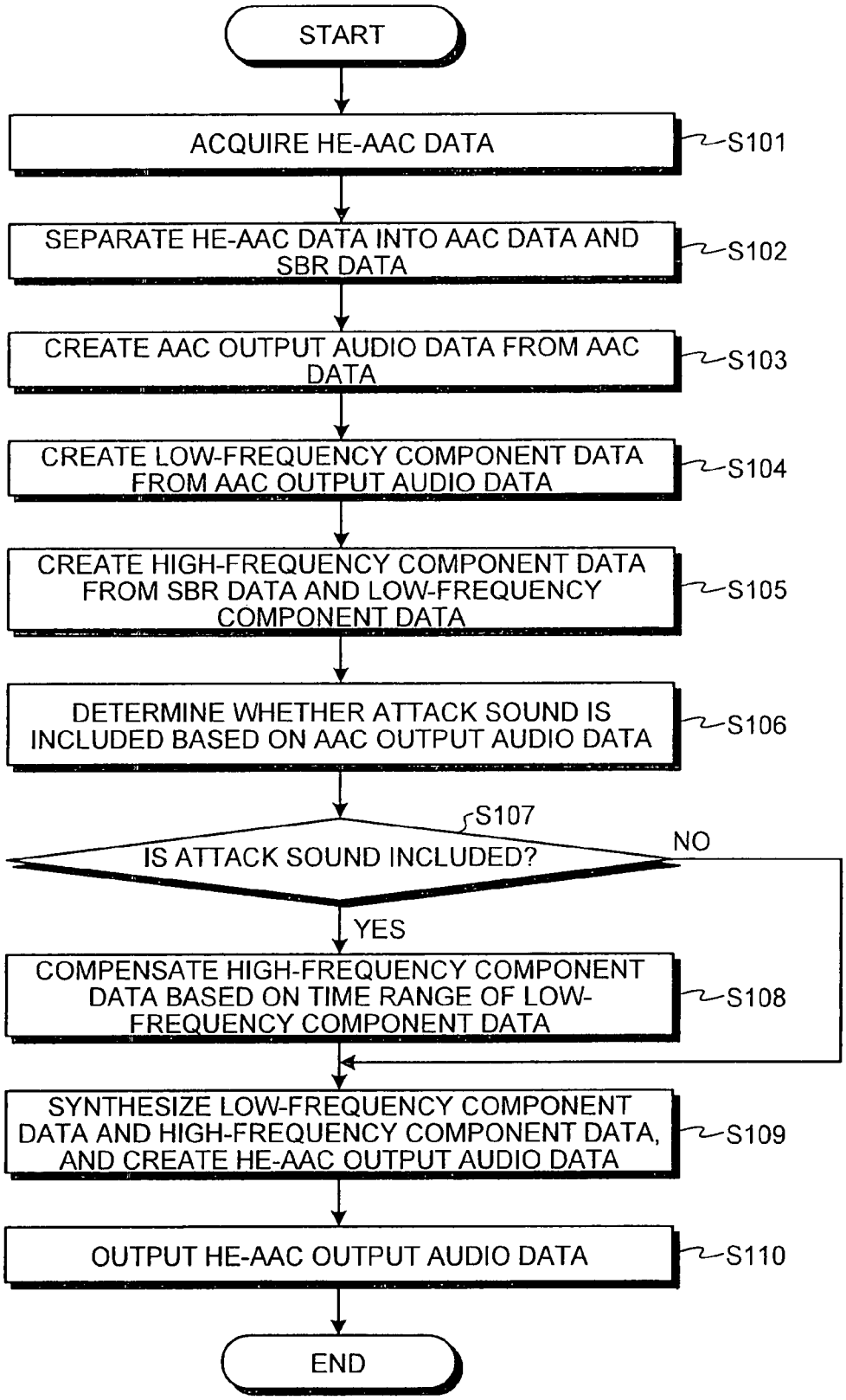
FIG. 4 is a flowchart of a process procedure performed by the decoder shown in FIG. 1.

A process procedure performed by the decoder 100 is explained below. As shown in FIG. 4, in the decoder 100, the data separating unit 110 acquires HE-AAC data (step S101), and separates the acquired HE-ACC data into the AAC data and the SBR data (step S102).

The AAC decoding unit 120 then decodes the AAC data, and creates AAC output audio data (step S103), and the analyzing filter 130 creates low-frequency component data from the AAC output audio data (step S104).

The high-frequency creating unit 140 creates high-frequency component data from the SBR data and the low-frequency component data (step S105). The transience determining unit 150 determines whether attack sound is included based on the AAC output audio data (step S106).

If the transience determining unit 150 determines that an attack sound is included, the high-frequency compensating unit 160 compensates the high-frequency component data based on the time range of the low-frequency component data (step S108).

The synthesizing filter 170 then synthesizes the low-frequency component data and the high-frequency component data, creates HE-AAC output audio data (step S109), and outputs the HE-AAC output audio data (step S110). By contrast, if the transience determining unit 150 determines that attack sound is not included (No at step S107), the process control directly goes to step S109.

Thus, when the transience determining unit 150 detects attack sound, the high-frequency compensating unit 160 compensates the high-frequency component data, so that an HE-AAC data can be properly decoded by compensating a high-frequency component of the HE-AAC data, even if the high-frequency component is not properly encoded.

As described above, even if a high-frequency component of HE-AAC data is not properly encoded, the decoder 100 can compensate the high-frequency component of the HE-AAC data, and can improve the sound quality of HE-AAC output audio data.

The decoder 100 can compensate a drawback of an encoder such that a high-frequency component of HE-AAC data is not properly encoded, so that the decoder 100 does not need to cope with such problem in the encoder, thereby reducing costs required for designing the encoder.

Although the decoder 100 corrects the time range of the high-frequency component data to the time range of the low-frequency component data when the high-frequency compensating unit 160 compensates the high-frequency component data, the present invention is not limited to this. For example, the time range of the high-frequency component data may be changed such that a difference between the time range of the high-frequency component data and the time range of the low-frequency component data is to be equal to or less than a threshold, and then the high-frequency component data corresponding to the time range before compensation may be concentrated to fit into the time range after compensation.

Second Embodiment

An overview and characteristics of a decoder 200 according to a second embodiment of the present invention are explained below. The decoder 200 determines whether HE-AAC data includes attack sound based on window data included in the HE-AAC data; and if it is determined that an attack sound is included, a high-frequency component is compensated in accordance with the time range of a low-frequency component.

The window data indicates a determination result of whether an audio signal includes attack sound, when an encoder (not shown, which encodes an audio signal) encodes a low-frequency component of the audio signal by the AAC method. If the window data is LONG, attack sound is not included in the audio signal, which means that time resolution (time range) of the AAC data is wide. In contrast, if the window data is SHORT, an attack sound is included in the audio signal, which means that time resolution (time range) of the AAC data is narrow.

Thus, a processing load on the decoder 200 required for detecting attack sound is reduced, so that the decoder 200 can compensate the high-frequency component efficiently.

Figure 5:
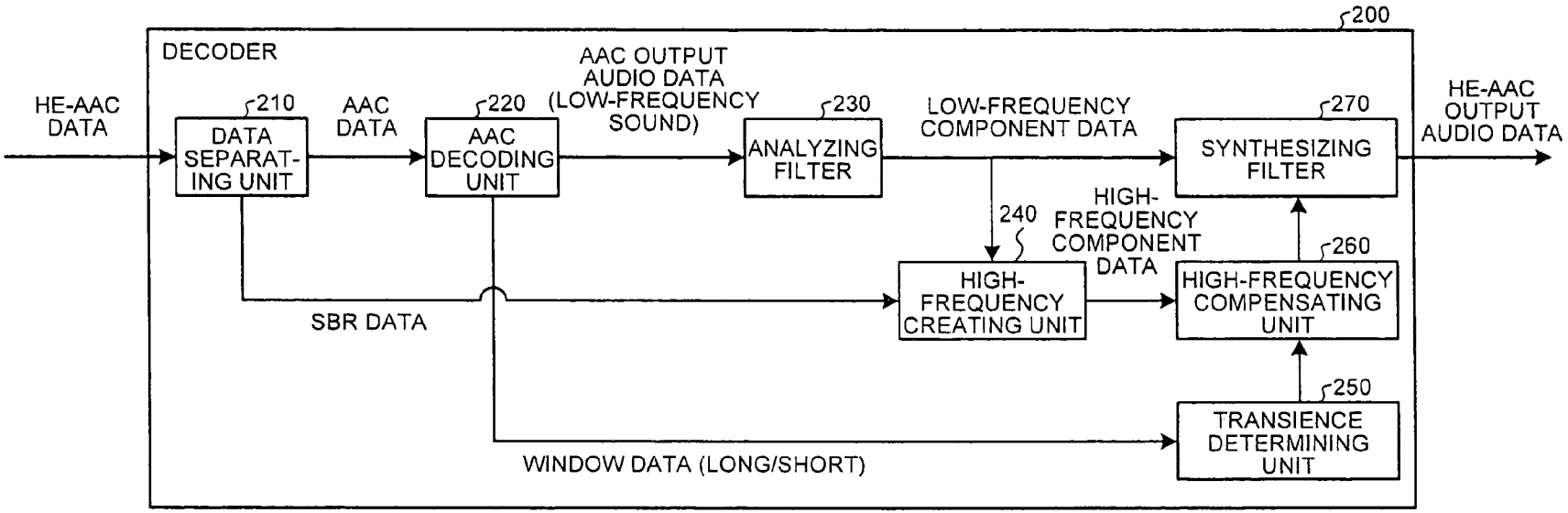
FIG. 5 is a functional block diagram of a decoder according to a second embodiment of the present invention.

A configuration of the decoder 200 is explained below. As shown in FIG. 5, the decoder 200 includes a data separating unit 210, an AAC decoding unit 220, an analyzing filter 230, a high-frequency creating unit 240, a transience determining unit 250, a high-frequency compensating unit 260, and a synthesizing filter 270.

When the data separating unit 210 acquires HE-AAC data, the data separating unit 210 separates the acquired HE-AAC data into the AAC data and the SBR data, outputs the AAC data to the AAC decoding unit 220, and outputs the SBR data to the high-frequency creating unit 240.

The AAC decoding unit 220 decodes AAC data, outputs the decoded AAC data as AAC output audio data to the analyzing filter 230, and outputs window data included in the AAC data to the transience determining unit 250.

The analyzing filter 230 calculates characteristics of time and frequency related to a low-frequency component of an audio signal based on AAC output audio data acquired from the AAC decoding unit 220, and outputs a calculation result to the synthesizing filter 270 and the high-frequency creating unit 240. Hereinafter, the calculation result output from the analyzing filter 230 is referred to as low-frequency component data.

The high-frequency creating unit 240 creates a high-frequency component of the audio signal based on SBR data acquired from the data separating unit 210 and low-frequency component data acquired from the analyzing filter 230. The high-frequency creating unit 240 then outputs the data of the created high-frequency component as the high-frequency component data of the audio signal to the high-frequency compensating unit 260.

The transience determining unit 250 acquires window data from the AAC decoding unit 220, determines whether HE-AAC data includes any attack sound, and outputs a determination result to the high-frequency compensating unit 260. Specifically, if the window data is LONG, the transience determining unit 250 determines that attack sound is not included; and if the window data is SHORT, determines that an attack sound is included.

The high-frequency compensating unit 260 acquires a determination result from the transience determining unit 250, and compensates high-frequency component data based on the acquired determination result. If the high-frequency compensating unit 260 acquires a determination result such that an attack sound is included, the high-frequency compensating unit 260 compensates the high-frequency component data, and outputs the compensated high-frequency component data to the synthesizing filter 270. By contrast, if the high-frequency compensating unit 260 acquires a determination result such that attack sound is not included, the high-frequency compensating unit 260 outputs directly the high-frequency component data to the synthesizing filter 270 without compensating the high-frequency component data.

The synthesizing filter 270 synthesizes low-frequency component data acquired from the analyzing filter 230 and high-frequency component data (or compensated high-frequency component data, if an attack sound is included) acquired from the high-frequency compensating unit 260, and outputs the synthesized data as HE-AAC output audio data. The HE-AAC output audio data is a result of decoding HE-AAC data.

Figure 6:
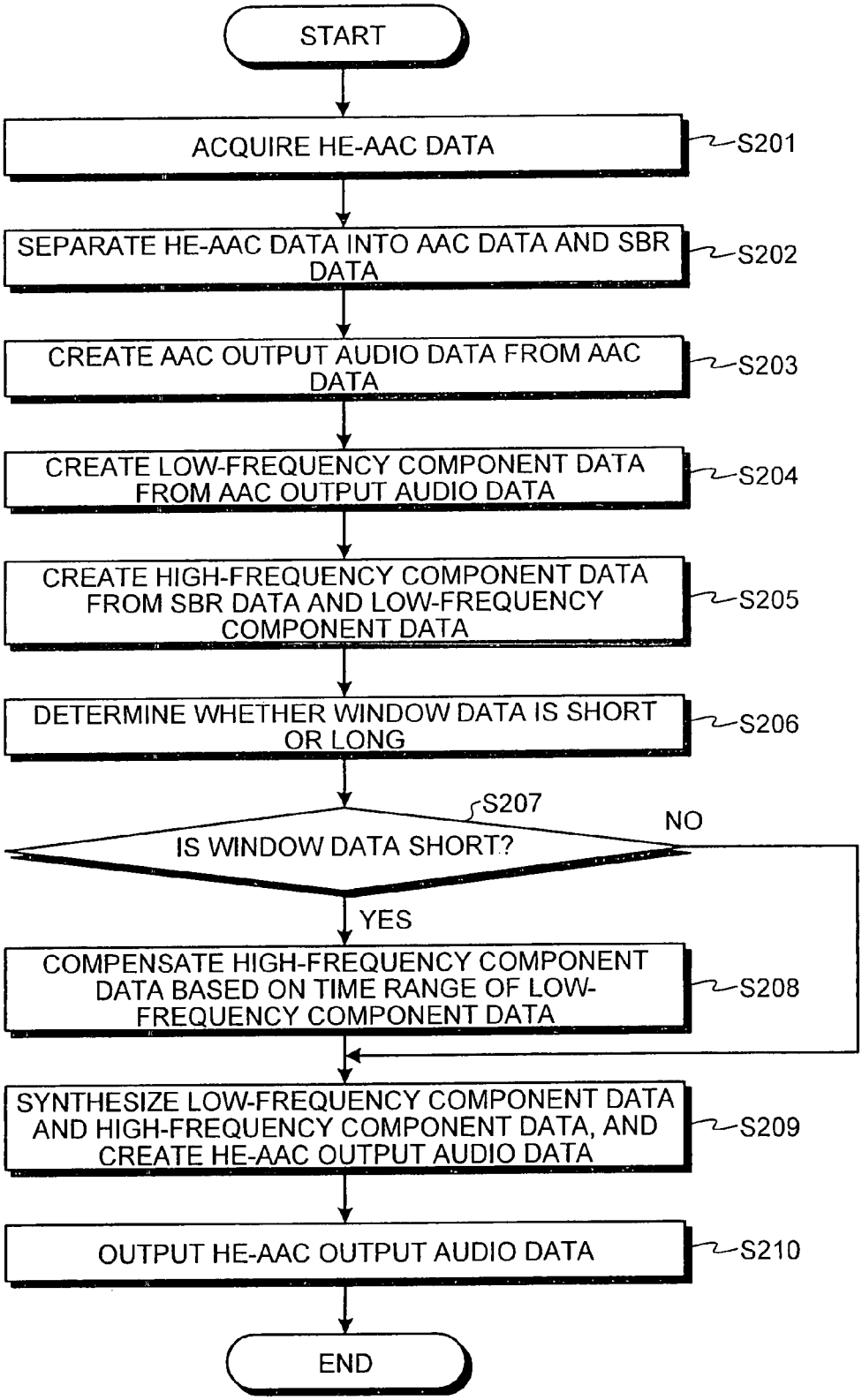
FIG. 6 is a flowchart of a process procedure performed by the decoder shown in FIG. 5.

A process procedure performed by the decoder 200 is explained below. As shown in FIG. 6, in the decoder 200, the data separating unit 210 acquires HE-AAC data (step S201), and separates the acquired HE-AAC data into the AAC data and the SBR data (step S202).

The AAC decoding unit 220 then decodes the AAC data, and creates AAC output audio data (step S203), and the analyzing filter 230 creates low-frequency component data from the AAC output audio data (step S204).

The high-frequency creating unit 240 creates high-frequency component data from the SBR data and the low-frequency component data (step S205). The transience determining unit 250 determines whether attack sound is included based on the window data (step S206).

If the transience determining unit 250 determines that an attack sound is included (when the window data is SHORT) (Yes at step S207), the high-frequency compensating unit 260 compensates the high-frequency component data based on the time range of the low-frequency component data (step S208).

The synthesizing filter 270 then synthesizes the low-frequency component data and the high-frequency component data, creates HE-AAC output audio data (step S209), and outputs the HE-AAC output audio data (step S210). By contrast, if the transience determining unit 250 determines that attack sound is not included (when the window data is LONG) (No at step S207), the process control goes to step S209.

Thus, the transience determining unit 250 determines whether attack sound is included based on the window data, so that detection of attack sound can be performed efficiently.

As described above, even if a high-frequency component of HE-AAC data is not properly encoded, the decoder 200 can compensate the high-frequency component of the HE-AAC data, and can improve the sound quality of HE-AAC output audio data.

Third Embodiment

An overview and characteristics of a decoder 300 according to a third embodiment of the present invention are explained below. The decoder 300 detects a time range in which attack sound occurs based on grouping data included in HE-AAC data. The decoder 300 corrects the time range of a high-frequency component based on the time range detected from the grouping data, and compensates the power of the high-frequency component, which is evened out within the time range before correction, in accordance with the time range after correction. Hereinafter, the time range detected from the grouping data is referred to as detected time range.

The grouping data is data that a single frame of an audio signal is divided into a certain number of samples (for example, 1024 samples), and included in HE-AAC data. The single frame includes, for example, relation between the time and the power of one frame of the audio signal.

Thus, the decoder 300 can compensate a high-frequency component more accurately, and can improve the sound quality of decoded HE-AAC output audio data.

Figure 7:
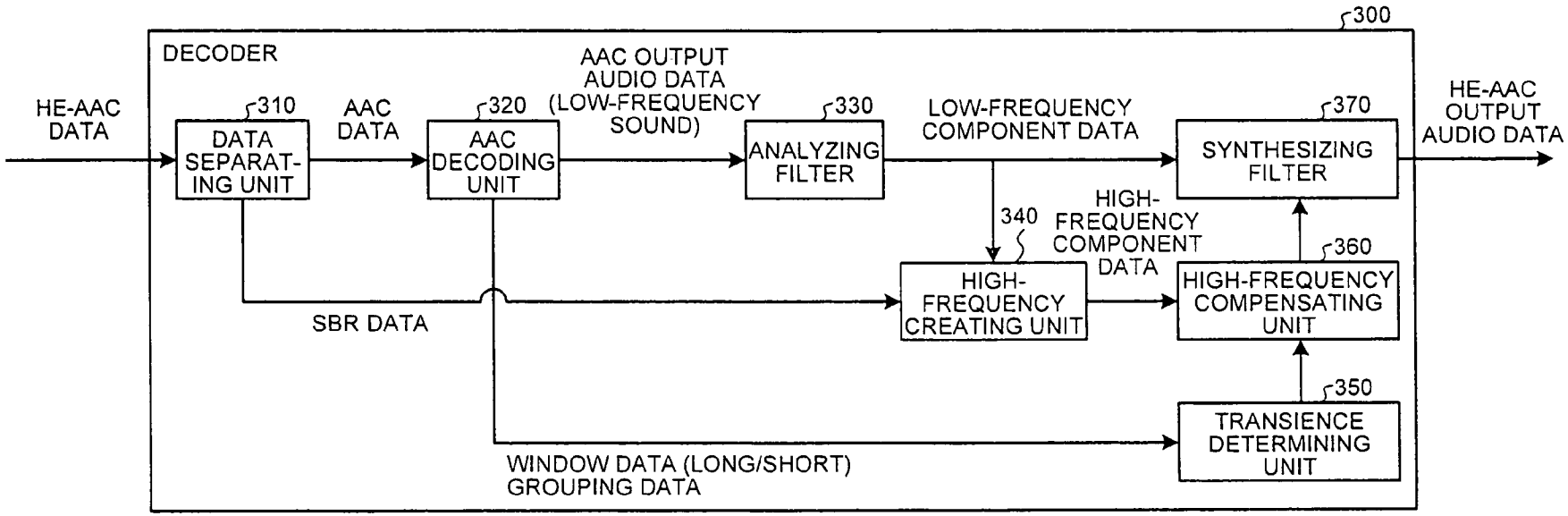
FIG. 7 is a functional block diagram of a decoder according to a third embodiment of the present invention.

A configuration of the decoder 300 is explained below. As shown in FIG. 7, the decoder 300 includes a data separating unit 310, an AAC decoding unit 320, an analyzing filter 330, a high-frequency creating unit 340, a transience determining unit 350, a high-frequency compensating unit 360, and a synthesizing filter 370.

When the data separating unit 310 acquires HE-AAC data, the data separating unit 310 separates the acquired HE-AAC data into the AAC data and the SBR data, outputs the AAC data to the AAC decoding unit 320, and outputs the SBR data to the high-frequency creating unit 340.

The AAC decoding unit 320 decodes AAC data, outputs the decoded AAC data as AAC output audio data to the analyzing filter 330, and outputs window data and grouping data included in the AAC data to the transience determining unit 350. Here, the window data is similar to the window data explained in the second embodiment, therefore explanation for it is omitted.

The analyzing filter 330 calculates characteristics of time and frequency related to a low-frequency component of an audio signal based on AAC output audio data acquired from the AAC decoding unit 320, and outputs a calculation result to the synthesizing filter 370 and the high-frequency creating unit 340. Hereinafter, the calculation result output from the analyzing filter 330 is referred to as low-frequency component data.

The high-frequency creating unit 340 creates a high-frequency component of the audio signal based on SBR data acquired from the data separating unit 310 and low-frequency component data acquired from the analyzing filter 330. The high-frequency creating unit 340 then outputs the data of the created high-frequency component as the high-frequency component data of the audio signal to the high-frequency compensating unit 360.

The transience determining unit 350 acquires window data from the AAC decoding unit 320, determines whether HE-AAC data includes any attack sound, and outputs a determination result to the high-frequency compensating unit 360. Specifically, if the window data is LONG, the transience determining unit 350 determines that attack sound is not included; and if the window data is SHORT, determines that an attack sound is included.

If the window data is SHORT, the transience determining unit 350 detects a detected time range based on grouping data, and outputs data of the detected time range to the high-frequency compensating unit 360.

Figure 8:
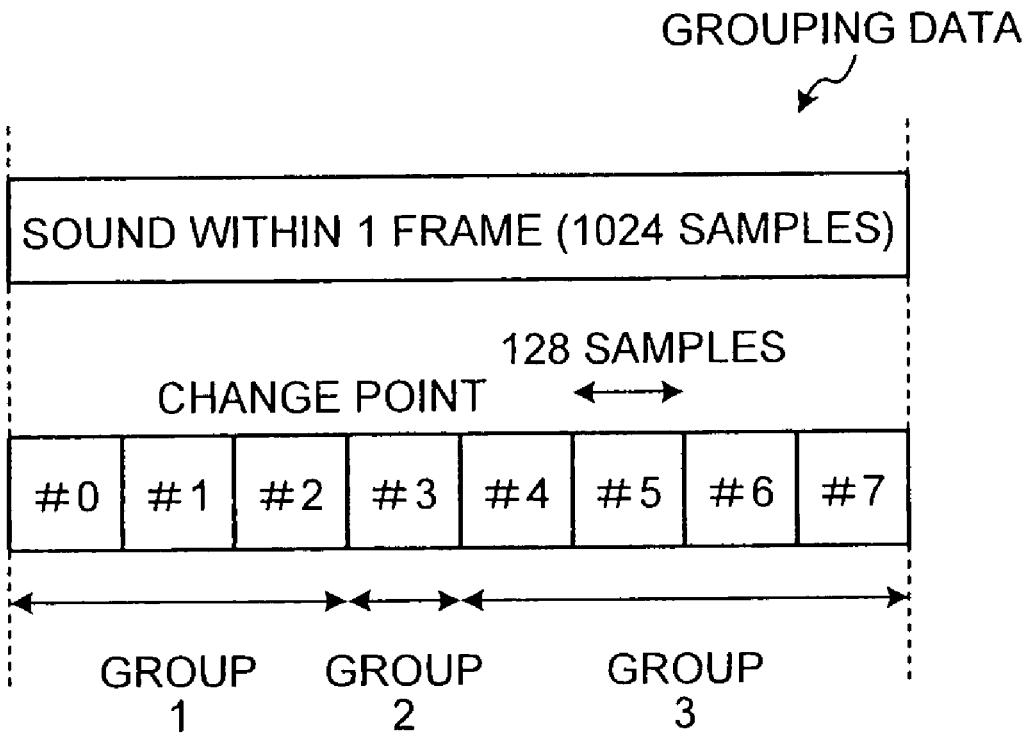
FIG. 8 is a schematic diagram for explaining processing for detecting a detected time range performed by a transience determining unit shown in FIG. 7.

As shown in FIG. 8, to begin with, the transience determining unit 350 divides grouping data made of 1024 samples into subframes #0 to #7, each of which includes 128 samples. The transience determining unit 350 then groups the subframes by comparing adjoining subframes.

For example, the transience determining unit 350 compares adjoining subframes, and groups the subframes in accordance with a change point at which a difference between the values (for example, the electric power of the audio signal) of the compared subframes is equal to or more than a threshold. In FIG. 8, suppose a difference between the value of the subframe #2 and the value of the subframe #3 is equal to or more than a threshold, and a difference between the value of the subframe #3 and the value of the subframe #4 is equal to or more than the threshold. Accordingly, the subframes are grouped, namely, the subframes #0 to #2 making a group 1, the subframes #3 making a group 2, the subframes #4 to #7 making a group 3.

The transience determining unit 350 then detects a time range (i.e., the time range of 128 samples in the example shown in FIG. 8) corresponding to the group 2 as a detected time range, and outputs data of the detected time range to the high-frequency compensating unit 360.

Returning to FIG. 7, the high-frequency compensating unit 360 acquires a determination result from the transience determining unit 350, and compensates high-frequency component data based on the acquired determination result. If the high-frequency compensating unit 360 acquires a determination result such that an attack sound is included, the high-frequency compensating unit 360 compensates the high-frequency component data based on a detected time range, and outputs the compensated high-frequency component data to the synthesizing filter 370. By contrast, if the high-frequency compensating unit 360 a determination result such that attack sound is not included, the high-frequency compensating unit 360 outputs directly the high-frequency component data to the synthesizing filter 370 without compensating the high-frequency component data.

A method of compensating high-frequency component data by the high-frequency compensating unit 360 based on a detected time range is similar to the method of compensating high-frequency component data by the high-frequency compensating unit 160 based on the time range of low-frequency component data (the time range of low-frequency component data is substituted for the detected time range), therefore explanation for it is omitted.

The synthesizing filter 370 synthesizes low-frequency component data acquired from the analyzing filter 330 and high-frequency component data (or compensated high-frequency component data, if an attack sound is included) acquired from the high-frequency compensating unit 360, and outputs the synthesized data as HE-AAC output audio data. The HE-AAC output audio data is a result of decoding HE-AAC data.

Figure 9:
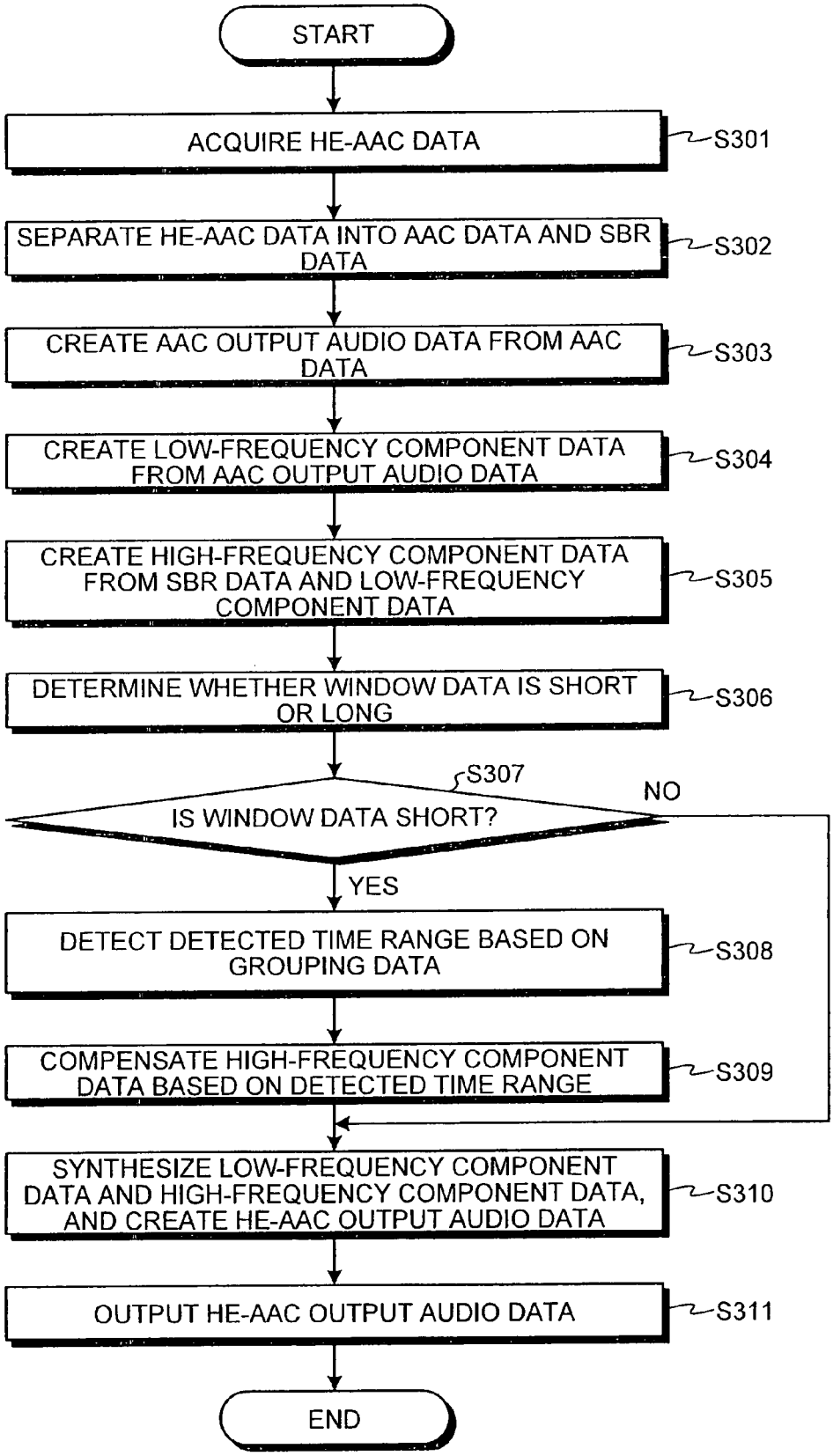
FIG. 9 is a flowchart of a process procedure performed by the decoder shown in FIG. 7.

A process procedure performed by the decoder 300 is explained below. As shown in FIG. 9, in the decoder 300, the data separating unit 310 acquires HE-AAC data (step S301), and separates the acquired HE-ACC data into the AAC data and the SBR data (step S302).

The AAC decoding unit 320 then decodes the AAC data, and creates AAC output audio data (step S303), and the analyzing filter 330 creates low-frequency component data from the AAC output audio data (step S304).

The high-frequency creating unit 340 creates high-frequency component data from the SBR data and the low-frequency component data (step S305). The transience determining unit 350 determines whether attack sound is included based on the AAC output audio data (step S306).

If the transience determining unit 350 determines that the window data is SHORT (Yes at step S307), the high-frequency compensating unit 360 detects a detected time range based on the grouping data (step S308), and compensates the high-frequency component data based on the detected time range (step S309).

The synthesizing filter 370 then synthesizes the low-frequency component data and the high-frequency component data, creates HE-AAC output audio data (step S310), and outputs the HE-AAC output audio data (step S311). By contrast, if the transience determining unit 350 determines that the window data is LONG (No at step S307), the process control goes to step S310.

Thus, the transience determining unit 350 detects an accurate time range in which an attack sound is included based on the grouping data, so that the sound quality of the HE-AAC output audio data can be improved.

As described above, the decoder 300 can compensate a high-frequency component more accurately, and can improve the sound quality of decoded HE-AAC output audio data.

Forth Embodiment

An overview and characteristics of a decoder 400 according to a fourth embodiment of the present invention are explained below. The decoder 400 stores therein a modified discrete cosine transform (MDCT) coefficient in a certain period, and compares the stored MDCT coefficient with another MDCT coefficient included HE-AAC data. If a difference between the compared MDCT coefficients is equal to or more than a threshold, it is determined that the HE-AAC data includes an attack sound, and the decoder 400 compensates a high-frequency component in accordance with the time range of a low-frequency component.

The MDCT coefficient is a value that the relation between the power (electric power) and the frequency of the low-frequency component of an audio signal is intermittently extracted. The decoder 400 prestores therein an average of MDCT coefficients in a certain period. Hereinafter, a MDCT coefficient prestored in a decoder is referred to as a reference MDCT coefficient, and a MDCT coefficient included in HE-AAC data is referred to as a comparative MDCT coefficient.

Thus, the decoder 400 determines whether HE-AAC data includes attack sound (whether an audio signal before encoded includes attack sound) based on a comparative MDCT coefficient included in the HE-AAC data and a reference MDCT coefficient, so that a processing load required for detecting attack sound is reduced, and a high-frequency component can be compensated efficiently.

Figure 10:
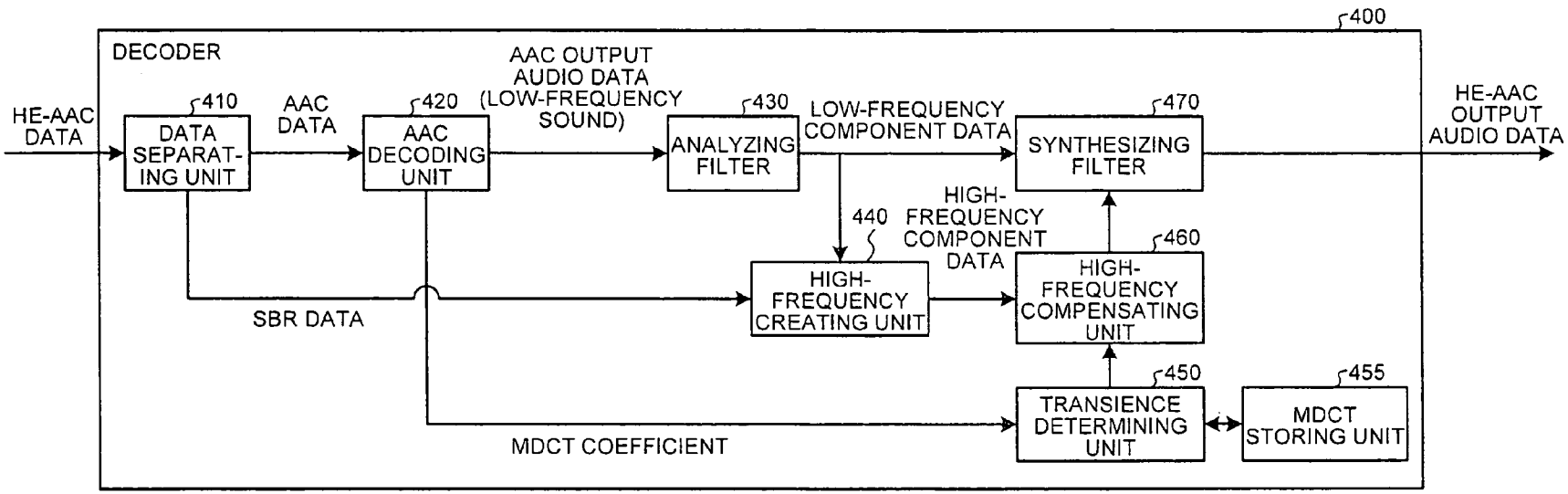
FIG. 10 is a functional block diagram of a decoder according to a fourth embodiment of the present invention.

A configuration of the decoder 400 is explained below. As shown in FIG. 10, the decoder 400 includes a data separating unit 410, an AAC decoding unit 420, an analyzing filter 430, a high-frequency creating unit 440, a transience determining unit 450, a high-frequency compensating unit 460, and a synthesizing filter 470.

When the data separating unit 410 acquires HE-AAC data, the data separating unit 410 separates the acquired HE-ACC data into the AAC data and the SBR data, outputs the AAC data to the AAC decoding unit 420, and outputs the SBR data to the high-frequency creating unit 440.

The AAC decoding unit 420 decodes AAC data, outputs the decoded AAC data as AAC output audio data to the analyzing filter 430, and outputs comparative MDCT coefficient included in the AAC data to the transience determining unit 450.

The analyzing filter 430 calculates characteristics of time and frequency related to a low-frequency component of an audio signal based on AAC output audio data acquired from the AAC decoding unit 420, and outputs a calculation result to the synthesizing filter 470 and the high-frequency creating unit 440. Hereinafter, the calculation result output from the analyzing filter 430 is referred to as low-frequency component data.

The high-frequency creating unit 440 creates a high-frequency component of the audio signal based on SBR data acquired from the data separating unit 410 and low-frequency component data acquired from the analyzing filter 430. The high-frequency creating unit 440 then outputs the data of the created high-frequency component as the high-frequency component data of the audio signal to the high-frequency compensating unit 460.

The transience determining unit 450 acquires a MDCT coefficient from the AAC decoding unit 420, determines whether HE-AAC data includes any attack sound, and outputs a determination result to the high-frequency compensating unit 460. Specifically, the transience determining unit 450 compares a comparative MDCT coefficient with a reference MDCT coefficient stored in the MDCT storing unit 455, and if a difference obtained from the comparison is equal to or more than a threshold, the transience determining unit 450 determines that an attack sound is included. By contrast, if a difference between the comparative MDCT coefficient and the reference MDCT coefficient is less than the threshold, the transience determining unit 450 determines that attack sound is not included. The MDCT storing unit 455 stores therein the reference MDCT coefficient.

The synthesizing filter 470 synthesizes low-frequency component data acquired from the analyzing filter 430 and high-frequency component data (or compensated high-frequency component data, if an attack sound is included) acquired from the high-frequency compensating unit 460, and outputs the synthesized data as HE-AAC output audio data. The HE-AAC output audio data is a result of decoding HE-AAC data.

Figure 11:
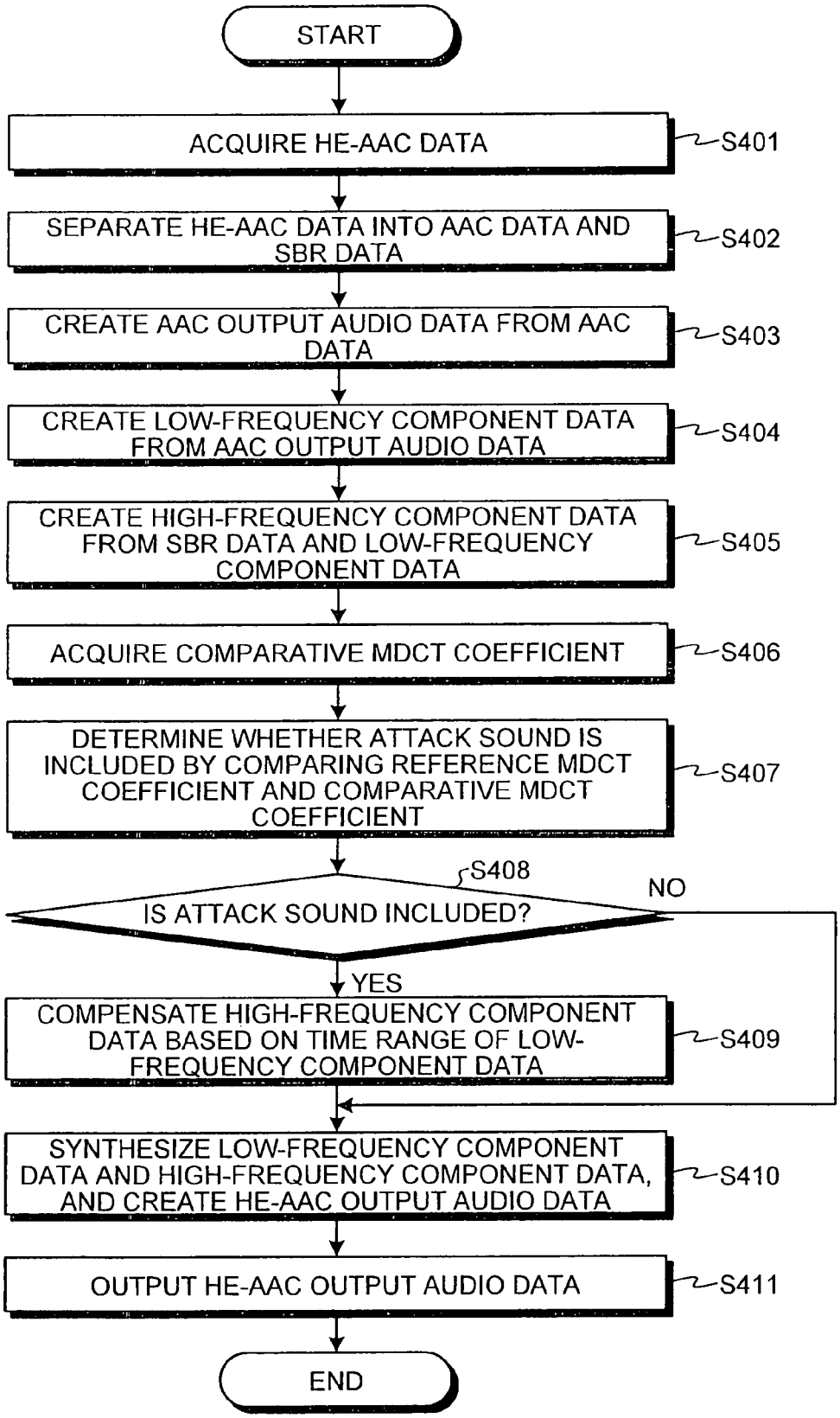
FIG. 11 is a flowchart of a process procedure performed by the decoder shown in FIG. 10.

A process procedure performed by the decoder 400 is explained below. As shown in FIG. 11, in the decoder 400, the data separating unit 410 acquires HE-AAC data (step S401), and separates the acquired HE-ACC data into the AAC data and the SBR data (step S402).

The AAC decoding unit 420 then decodes the AAC data, and creates AAC output audio data (step S403), and the analyzing filter 430 creates low-frequency component data from the AAC output audio data (step S404).

The high-frequency creating unit 440 creates high-frequency component data from the SBR data and the low-frequency component data (step S405). The transience determining unit 450 acquires a comparative MDCT coefficient (step S406), and determines whether attack sound is included by comparing the comparative MDCT coefficient and the reference MDCT coefficient (step S407).

If the transience determining unit 450 determines that an attack sound is included (Yes at step S408), the high-frequency compensating unit 460 compensates the high-frequency component data based on the time range of the low-frequency component data (step S409).

The synthesizing filter 470 then synthesizes the low-frequency component data and the high-frequency component data, creates HE-AAC output audio data (step S410), and outputs the HE-AAC output audio data (step S411). By contrast, if the transience determining unit 450 determines that attack sound is not included (No at step S408), the process control directly goes to step S410.

Thus, the transience determining unit 450 determines whether attack sound is included based on the comparative MDCT coefficient and the reference MDCT coefficient, so that detection of attack sound can be performed efficiently.

As described above, even if a high-frequency component of HE-AAC data is not properly encoded, the decoder 400 can compensate the high-frequency component of the HE-AAC data, and can improve the sound quality of HE-AAC output audio data efficiently.

The transience determining unit 450 may renew the reference MDCT coefficient stored in the MDCT storing unit 455 based on the comparative MDCT coefficient acquired from the AAC decoding unit 420, if the comparison result between the comparative MDCT coefficient and the reference MDCT coefficient is less than the threshold. Any method of renewing may be used, for example, an average of the comparative MDCT coefficient and the reference MDCT coefficient can be a new reference MDCT coefficient.

Thus, detection of attack sound can be performed more accurately by renewing the reference MDCT coefficient stored in the MDCT storing unit 455.

Fifth Embodiment

An overview and characteristics of a decoder 500 according to a fifth embodiment of the present invention are explained below. The decoder 500 determines whether HE-AAC data includes attack sound based on data of a low-frequency component and a high-frequency component included in the HE-AAC data, and if it is determined that an attack sound is included, the decoder 500 compensates the high-frequency component in accordance with the time range of the low-frequency component.

Thus, the decoder 500 can detect attack sound more accurately.

Figure 12:
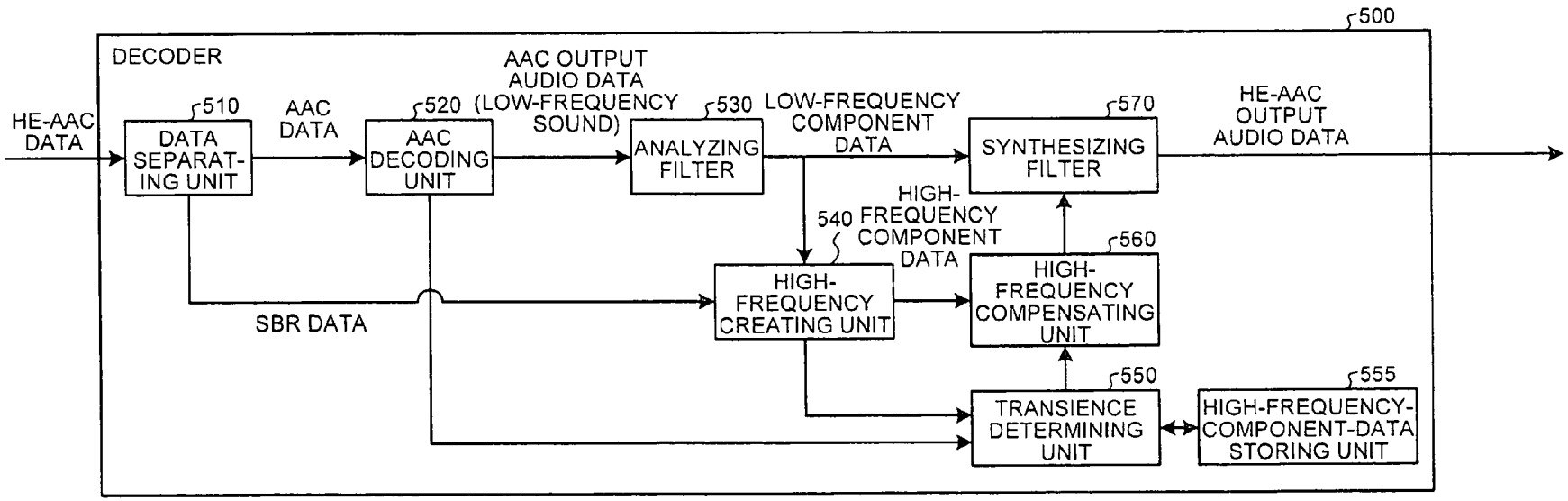
FIG. 12 is a functional block diagram of a decoder according to a fifth embodiment of the present invention.

A configuration of the decoder 500 is explained below. As shown in FIG. 12, the decoder 500 includes a data separating unit 510, an AAC decoding unit 520, an analyzing filter 530, a high-frequency creating unit 540, a transience determining unit 550, a high-frequency component data storing unit 555, a high-frequency compensating unit 560, and a synthesizing filter 570.

When the data separating unit 510 acquires HE-AAC data, the data separating unit 510 separates the acquired HE-ACC data into the AAC data and the SBR data, outputs the AAC data to the AAC decoding unit 520, and outputs the SBR data to the high-frequency creating unit 540.

The AAC decoding unit 520 decodes AAC data, outputs the decoded AAC data as AAC output audio data to the analyzing filter 530 and the transience determining unit 550. The analyzing filter 530 calculates characteristics of time and frequency related to a low-frequency component of an audio signal based on AAC output audio data acquired from the AAC decoding unit 520, and outputs a calculation result to the synthesizing filter 570 and the high-frequency creating unit 540. Hereinafter, the calculation result output from the analyzing filter 530 is referred to as low-frequency component data.

The high-frequency creating unit 540 creates a high-frequency component of the audio signal based on SBR data acquired from the data separating unit 510 and low-frequency component data acquired from the analyzing filter 530. The high-frequency creating unit 540 then outputs the data of the created high-frequency component as the high-frequency component data of the audio signal to the high-frequency compensating unit 560.

The transience determining unit 550 acquires AAC output audio data from the AAC decoding unit 520 and high-frequency component data from the high-frequency creating unit 540, determines whether HE-AAC data includes any attack sound, and outputs a determination result to the high-frequency compensating unit 560.

Specifically, if the transience determining unit 550 determines that an attack sound is included based on the AAC output audio data, and additionally determines that attack sound is included based on the high-frequency component data, the transience determining unit 550 concludes that attack sound is included. By contrast, if the transience determining unit 550 determines that attack sound is not included based on either of the AAC output audio data or the high-frequency component data, the transience determining unit 550 concludes that attack sound is not included. A method of determining whether attack sound is included based on AAC output audio data is similar to the methods described in the first to fourth embodiments, therefore explanation for it is omitted.

A method of determining whether attack sound is included based on high-frequency component data by the transience determining unit 550 is explained below. The transience determining unit 550 acquires an average of high-frequency component data within a certain period in the past stored in the high-frequency-component-data storing unit 555 (hereinafter, "reference high-frequency component data"), compares the acquired reference high-frequency component data with high-frequency component data output from the high-frequency creating unit 540. If a difference as a result of the comparison is equal to or more than a threshold, the transience determining unit 550 determines that an attack sound is included. The high-frequency-component-data storing unit 555 stores therein reference high-frequency component data.

If a difference between high-frequency component data output from the high-frequency creating unit 540 and the reference high-frequency component data is less than the threshold, the transience determining unit 550 renews the reference high-frequency component data stored in the high-frequency-component-data storing unit 555 based on the high-frequency component data acquired from the high-frequency creating unit 540. For example, the transience determining unit 550 makes an average of the reference high-frequency component data and the high-frequency component data acquired from the high-frequency creating unit 540 as a new reference high-frequency component data.

The high-frequency compensating unit 560 acquires a determination result from the transience determining unit 550, and compensates high-frequency component data based on the acquired determination result. If the high-frequency compensating unit 560 acquires a determination result such that an attack sound is included, the high-frequency compensating unit 560 compensates the high-frequency component data, and outputs the compensated high-frequency component data to the synthesizing filter 570. By contrast, if the high-frequency compensating unit 560 acquires a determination result such that attack sound is not included, the high-frequency compensating unit 560 outputs directly the high-frequency component data to the synthesizing filter 570 without compensating the high-frequency component data.

The synthesizing filter 570 synthesizes low-frequency component data acquired from the analyzing filter 530 and high-frequency component data (or compensated high-frequency component data, if an attack sound is included) acquired from the high-frequency compensating unit 560, and outputs the synthesized data as HE-AAC output audio data. The HE-AAC output audio data is a result of decoding HE-AAC data.

Figure 13:
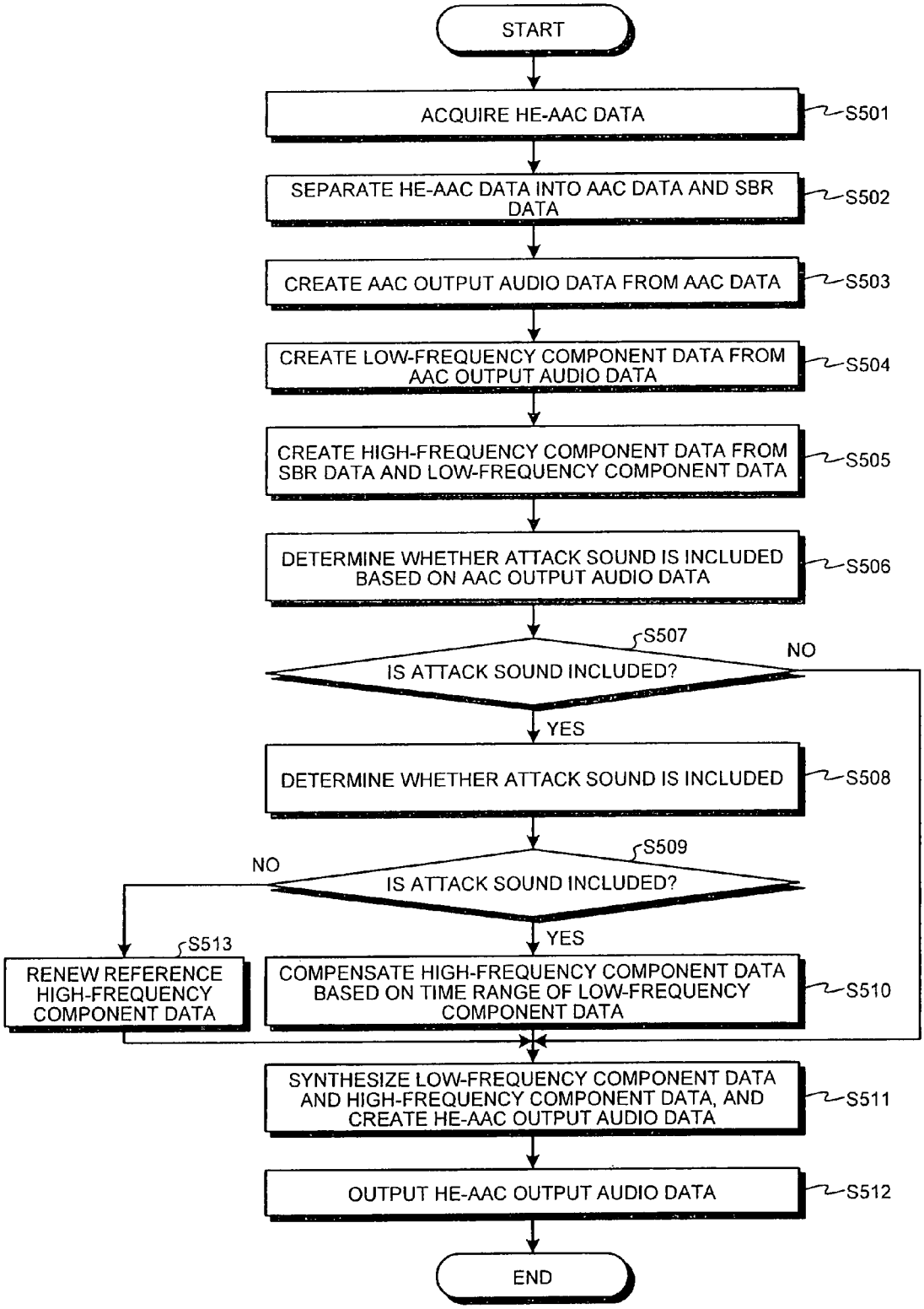
FIG. 13 is a flowchart of a process procedure performed by the decoder shown in FIG. 12.
Figure 14:
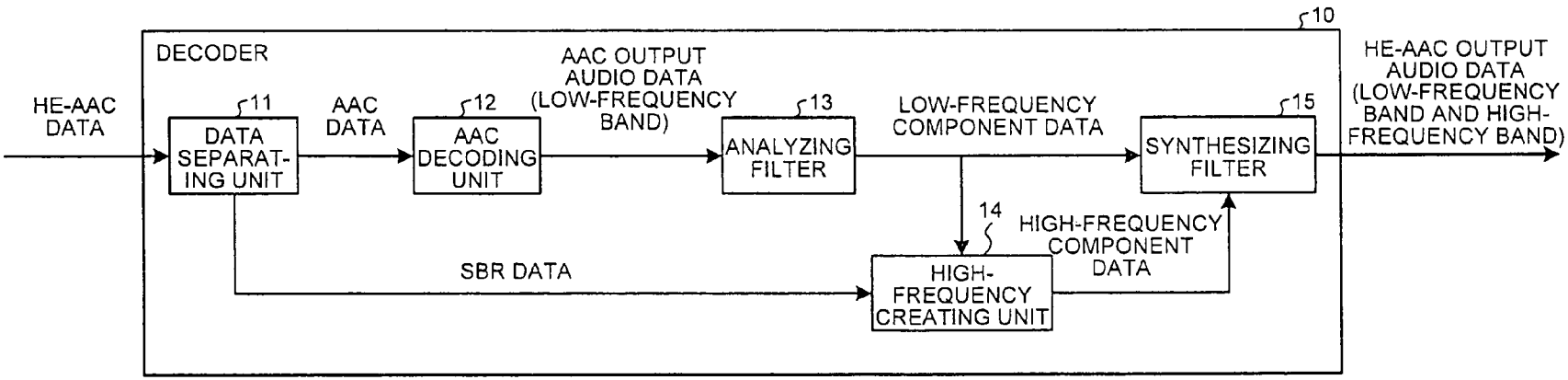
FIG. 14 is a functional block diagram of a conventional decoder.
Figure 15:
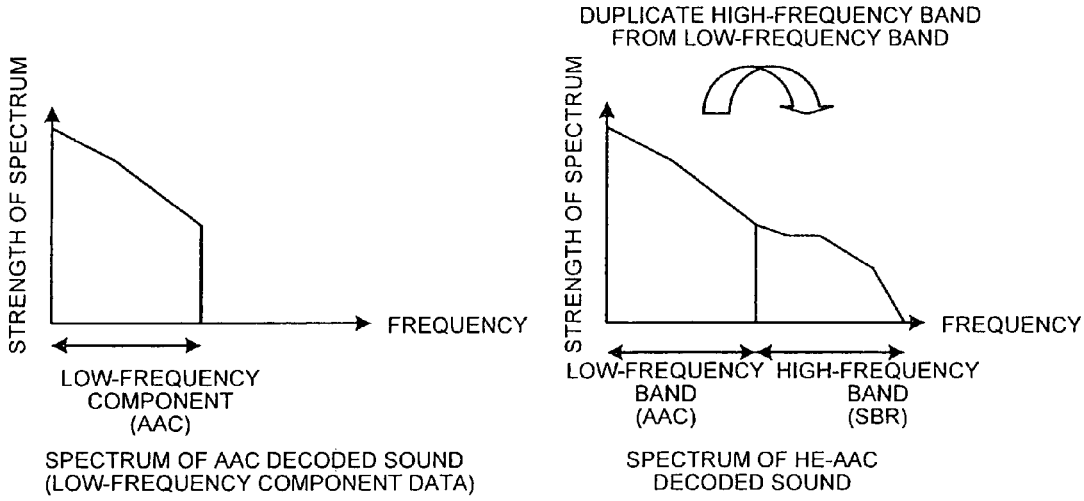
FIG. 15 is a schematic diagram for explaining an overview of processing performed by the conventional decoder.
Figure 16:
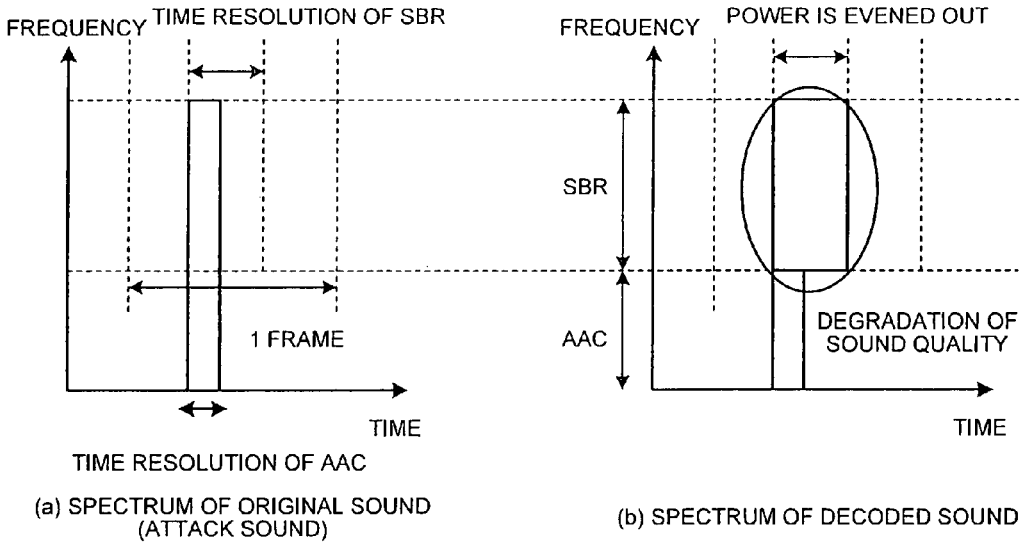
FIG. 16 is a schematic diagram for explaining a problem of a conventional technology.

A process procedure performed by the decoder 500 is explained below. As shown in FIG. 13, in the decoder 500, the data separating unit 510 acquires HE-AAC data (step S501), and separates the acquired HE-AAC data into the AAC data and the SBR data (step S502).

The AAC decoding unit 520 then decodes the AAC data, and creates AAC output audio data (step S503), and the analyzing filter 530 creates low-frequency component data from the AAC output audio data (step S504).

The high-frequency creating unit 540 creates high-frequency component data from the SBR data and the low-frequency component data (step S505). The transience determining unit 550 determines whether attack sound is included based on the AAC output audio data (step S506).

If the transience determining unit 550 determines that attack sound is included based on AAC output audio data (Yes at step S507), the transience determining unit 550 determines whether attack sound is included based on the high-frequency component data (step S508). If it is determined that an attack sound is included (Yes at step S509), the high-frequency compensating unit 560 compensates the high-frequency component data based on the time range of the low-frequency component data (step S510).

The synthesizing filter 570 then synthesizes the low-frequency component data and the high-frequency component data, creates HE-AAC output audio data (step S511), and outputs the HE-AAC output audio data (step S512). By contrast, if it is determined that attack sound is not included based on the AAC output audio data (No at step S507), the process control directly goes to step S511. If it is determined that attack sound is not included based on the high-frequency component data (No at step S509), the transience determining unit 550 renews the reference high-frequency component data (step S513), and then the process control goes to step S511.

Thus, because the transience determining unit 550 determines whether attack sound is included based on the AAC output audio data and the high-frequency component data, the transience determining unit 550 can determines whether attack sound is included more accurately.

As described above, the decoder 500 can accurately detect attack sound, compensate high-frequency component of HE-AAC data, and improve the sound quality of HE-AAC output audio data efficiently.

In addition to the embodiments described above, the present invention may be implemented in various embodiments within the scope of technical concepts described in the claims.

Among the processing explained in the embodiments, the whole or part of the processing explained as processing to be automatically performed may be performed manually, and the whole or part of the processing explained as processing to be manually performed may be automatically performed in a known manner.

The process procedures, the control procedures, specific names, information including various data and parameters shown in the description and the drawings may be changed as required unless otherwise specified.

Each of the configuration elements of each device shown in the drawings is functional and conceptual, and not necessarily to be physically configured as shown in the drawings. In other words, a practical form of separation and integration of each device is not limited to that shown in the drawings. The whole or part of the device may be configured by separating or integrating functionally or physically by any scale unit depending on various loads or use conditions.

According to an aspect of the present invention, an audio signal can be properly decoded, and the sound quality of a high-frequency component can be improved.

According to another aspect of the present invention, a high-frequency component can be properly compensated.

According to still another aspect of the present invention, an audio signal can be properly decoded while reducing a load on a decoding apparatus.

According to still another aspect of the present invention, attack sound can be detected more efficiently.

According to still another aspect of the present invention, attack sound can be detected more efficiently while reducing a load on a decoding apparatus.

According to still another aspect of the present invention, erroneous detection of attack sound can be prevented, and attack sound can be detected more accurately.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A decoding apparatus that decodes an audio signal by decoding a first encoded data that is encoded into a first time range from a low-frequency component of the audio signal, and by decoding a second encoded data that is encoded into a second time range from a high-frequency component of the audio signal, the second encoded data is used when creating a high-frequency component of the audio signal from the low-frequency component, the decoding apparatus comprising:

a high-frequency compensating device that changes the second time range to a third time range corresponding to the first time range, and compensates the high-frequency component created from the second encoded data based on the first time range such that an electric power of the high-frequency component in the third time range after compensation becomes sum of an electric power of the high-frequency component in the third time range before compensation and an electric power of the high-frequency component in a time range obtained by subtracting the third time range from the second time range before compensation; and a decoding device that decodes the audio signal by synthesizing the high-frequency component compensated by the high-frequency compensating device, and the low-frequency component decoded from the first encoded data.

2. The decoding apparatus according to claim 1, further comprising:

an attack-sound determining device that determines whether the audio signal includes attack sound that is a component of the audio signal that changes by equal to or more than a threshold within a certain time range, wherein the high-frequency compensating device compensates the high-frequency component if the audio signal includes the attack sound.

3. The decoding apparatus according to claim 2, wherein the attack-sound determining device determines whether the audio signal includes the attack sound based on a decoded result of the first encoded data.

4. The decoding apparatus according to claim 2, wherein the first encoded data include attack-sound presence data that indicate whether the attack sound is included in the audio signal, and the attack-sound determining device determines whether the audio signal includes the attack sound based on the attack-sound presence data.

5. The decoding apparatus according to claim 2, further comprising:

a low-frequency storing device that stores data of the low-frequency component in a certain period, wherein the attack-sound determining device determines whether the audio signal includes the attack sound based on the low-frequency component decoded from the first encoded data and the low-frequency component stored in the low-frequency storing device.

6. The decoding apparatus according to claim 2, wherein the attack-sound determining device determines whether the audio signal includes the attack sound by further using the high-frequency component.

7. A decoding method for decoding an audio signal by decoding a first encoded data that is encoded into a first time range from a low-frequency component of the audio signal, and by decoding a second encoded data that is encoded into a second time range from a high-frequency component of the audio signal, the second encoded data is used when creating a high-frequency component of the audio signal from the low-frequency component, the decoding method comprising:

changing the second time range to a third time range corresponding to the first time range;

high-frequency compensating, using a high-frequency compensating device, the high-frequency component created from the second encoded data based on the first time range such that an electric power of the high-frequency component in the third time range after compensation becomes sum of an electric power of the high-frequency component in the third time range before compensation and an electric power of the high-frequency component in a time range obtained by subtracting the third time range from the second time range before compensation; and decoding the audio signal by synthesizing the high-frequency component compensated at the high-frequency compensating, and the low-frequency component decoded from the first encoded data.

8. The decoding method according to claim 7, further comprising attack-sound determining whether the audio signal includes attack sound that is a component of the audio signal that changes by equal to or more than a threshold within a certain time range, wherein the high-frequency compensating includes compensating the high-frequency component if the audio signal includes the attack sound.

9. The decoding method according to claim 8, wherein the attack-sound determining includes determining whether the audio signal includes the attack sound based on a decoded result of the first encoded data.

10. The decoding method according to claim 8, wherein the first encoded data include attack-sound presence data that indicate whether the attack sound is included in the audio signal, and the attack-sound determining includes determining whether the audio signal includes the attack sound based on the attack-sound presence data.

11. The decoding method according to claim 8, further comprising storing data of the low-frequency component in a certain period, wherein the attack-sound determining includes determining whether the audio signal includes the attack sound based on the low-frequency component decoded from the first encoded data and the low-frequency component stored at the storing.

12. The decoding method according to claim 8, wherein the attack-sound determining includes determining whether the audio signal includes the attack sound by further using the high-frequency component.

* * * * *